US007299893B2

(12) United States Patent
Meyer et al.

(10) Patent No.: US 7,299,893 B2
(45) Date of Patent: Nov. 27, 2007

(54) LOUDSPEAKER HORN AND METHOD FOR CONTROLLING GRATING LOBES IN A LINE ARRAY OF ACOUSTIC SOURCES

(75) Inventors: John D. Meyer, Berkeley, CA (US); Perrin Meyer, Albany, CA (US); Roger Schwenke, Albany, CA (US)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 190 days.

(21) Appl. No.: 10/783,705

(22) Filed: Feb. 20, 2004

(65) Prior Publication Data

US 2004/0216948 A1 Nov. 4, 2004

Related U.S. Application Data

(60) Provisional application No. 60/452,975, filed on Mar. 7, 2003, provisional application No. 60/448,911, filed on Feb. 21, 2003.

(51) Int. Cl.
*G10K 11/20* (2006.01)
*H04R 1/30* (2006.01)

(52) U.S. Cl. ..... 181/188; 181/159; 181/177; 181/187; 181/191

(58) Field of Classification Search ..... 181/152, 181/159, 177, 187, 188, 185, 191, 192
See application file for complete search history.

(56) References Cited

U.S. PATENT DOCUMENTS 1,992,268 A 2/1935 Wente
2,135,610 A 11/1938 Wente
2,537,141 A 1/1951 Klipsch
4,071,112 A 1/1978 Keele, Jr.
4,344,504 A * 8/1982 Howze ..... 181/187
4,390,078 A 6/1983 Howze et al.
4,685,532 A 8/1987 Gunness
4,845,759 A * 7/1989 Danley ..... 381/97
5,020,630 A * 6/1991 Gunness ..... 181/192
5,590,214 A * 12/1996 Nakamura ..... 381/182
5,925,856 A 7/1999 Meyer et al.
6,016,353 A * 1/2000 Gunness ..... 381/342
6,112,847 A * 9/2000 Lehman ..... 181/152
6,393,131 B1 5/2002 Rexroat
6,394,223 B1 * 5/2002 Lehman ..... 181/152
6,668,969 B2 12/2003 Meyer et al.

* cited by examiner

*Primary Examiner*—Lincoln Donovan
*Assistant Examiner*—Jeremy Luks
(74) *Attorney, Agent, or Firm*—Donald L. Beeson; Beeson Skinner Beverly, LLP

(57) ABSTRACT

A loudspeaker horn (11) having a throat end (13) for receiving acoustic power from aligned acoustic power sources (41, 43, 45), an elongated throat (33), and a flared section (17) is provided with grating lobe mitigation fins (27, 29) that extend substantially parallel to the propagation axis of the horn from the throat end toward the mouth end of the horn's flared section. The length of the grating lobe mitigation fins is established in accordance with the degree of suppression of the grating lobes produced by the aligned acoustic power sources that is desired.

31 Claims, 8 Drawing Sheets

LOUDSPEAKER HORN AND METHOD FOR CONTROLLING GRATING LOBES IN A LINE ARRAY OF ACOUSTIC SOURCES

CROSS-REFERENCE TO RELATED APPLICATIONS

This application claims the benefit of provisional application 60/448,911, filed Feb. 21, 2003, and provisional application 60/452,975 filed Mar. 7, 2003.

BACKGROUND OF THE INVENTION

The present invention generally relates to loudspeakers that utilize aligned acoustic power sources ("line arrays") and to the problem of undesirable grating lobes produced by line arrays. The invention particularly involves a horn structure, and a method for which can be used with multiple aligned drivers to control normally occurring grating lobes produced by the driver alignment.

Line arrays are well known for their directional characteristics and ability to project acoustic power from multiple acoustic power sources over large distances. However, the disadvantage of line arrays is that grating lobes develop when the distance between the acoustic sources of the array is one wavelength or larger. To achieve a highest possible operating frequency and high output power without grating lobes, one needs to use a large number of very small sources. Increasing the number of elements increases the number of parts and connections, which makes manufacturing difficult. It is also difficult to obtain the necessary power out of very small transducers.

Currently, there are many variations on the line array. Most variations focus on changing the signal that goes to each element. Line arrays have been made where the signal magnitude, signal phase, and signal frequency content are altered for each element in the array. More often than not this decreases the maximum on axis power of the array. Also, though gain and phase shading can alter the width of the main lobe and structure of the side lobes, it is not possible to mitigate grating lobes.

The invention can be understood from a mathematical model of the line array. The acoustic pressure in the far field of a line array of N sources, each of which has directionality $H_s(\theta)$, is:

$$P(r, \theta, t) = \sum_{i=1}^{N} H_s(\theta)\frac{1}{r_i}e^{j(\omega t - kr_i)}$$

where θ is the angle, $r_i$ is the distance from the ith source to the point in space [r, θ], t is time, ω is the frequency in radians per second, and k is the wave number where ω=kc and c is the wave propagation speed. The directionality of an omni directional source is 1 everywhere ($H_0(\theta)=1$) so one can multiply any term in the equation above by the directionality of an omni and the acoustic pressure remains the same. Also the directionality of an individual source can be factored out of the sum:

$$P(r, \theta, t) = H_s(\theta)\left(\sum_{i=1}^{N} H_o(\theta)\frac{1}{r_i}e^{j(\omega t - kr_i)}\right)$$

In this form it can be seen that the directionality of an array of aligned sources is equal to the directionality of an array of omni directional sources multiplied by the directionality of an individual source. This is called the product theorem.

For an array of omni directional sources in a straight line, each separated by distance d the directionality is:

$$P_{ao}(r, \theta, t) = \frac{1}{r}e^{j(\omega t - kr)}\left(\frac{\sin\left(\frac{N}{2}kd\sin(\theta)\right)}{\sin\left(\frac{1}{2}kd\sin(\theta)\right)}\right)$$

There are maxima in the absolute value of this function when:

$$|\sin(\theta)| = \frac{m\lambda}{d}$$

where m is any integer. The term |sin(θ)| has a maximum of 1, so there will be more than one maxima when d>λ. These are called grating lobes.

The present invention provides a horn structure for a line array of acoustic power sources that controls these undesirable grating lobes, as well as a method of designing such a horn. Referring to the product theorem for the directionality of an array of aligned sources, the invention uses horn loading to effectively choose a directionality for an individual source which is zero (or very small) in those directions where one expects grating lobes. Because horns achieve directionality by reflecting sound into a concentrated angle, the effect of this approach is to reflect sound that would otherwise contribute to the grating lobes, into the source's main lobe. The invention increases the highest operating frequency beyond that which the line array would normally be restricted due to the separation between acoustic power sources. It also increases the available on-axis power, and reduces the number of required acoustic power sources needed to obtain a desired power output by increasing the allowable size of each source. It is noted that the approach of the invention may be applied to any transducers of waves in linear media, including microphones, and transmitters and receivers of electromagnetic waves.

SUMMARY OF THE INVENTION

Briefly, in one aspect of the invention a horn is provided for horn loading multiple aligned acoustic power sources that are relatively widely spaced apart, that is, spaced apart by a wavelength or more at the highest operating frequency of the line array of sources. The horn includes a mouth end, a throat end and a flared section between the mouth end and throat end. The horn's throat end has a mounting flange to which the acoustic power sources of the line array of sources can be mounted, and which has a coupling port for each of the acoustic power sources. The acoustic power source coupling ports fix the spacing of the line array of power sources and couple the acoustic power generated by the sources to the flared section of the horn through throat openings associated with each acoustic power source. Grating lobe fins positioned in the flared section of the horn between the acoustic power sources extend from the throat opening associated with each power source toward the mouth end of the horn to a sufficient length for mitigating the predicted grating lobes produced by the line array to a desired level. The throat end of the horn is relatively short. It is sized to have dimensions on the order of a wavelength or smaller at the highest operating frequency; it also provides a suitable transition between the geometry of each acoustic power source mounted to the horn's mounting flange and the geometry of the throat opening associated with each these sources.

In another aspect of the invention a loudspeaker is provided comprised of a multiple aligned acoustic power sources mounted to the throat end of a horn made in accordance with the invention.

In still another aspect of the invention a method of designing a horn to suppress the grating lobes produced by multiple aligned acoustic power sources is comprised of choosing a desired acoustic source for a line array of power sources, choosing a desired level of suppression for the predicted grating lobes for the line array, empirically designing the length of grating lobe fins for a single one of acoustic power sources to a achieve directional characteristic for the single source that suppresses off-axis acoustic power in the region of predicted grating lobes for the line array to the desired suppression level for the grating lobes, and providing a horn in accordance with the invention having grating lobe fins of a length designed for the single source, or longer.

DETAILED DESCRIPTION OF THE ILLUSTRATED EMBODIMENT OF THE INVENTION

Figure 1:
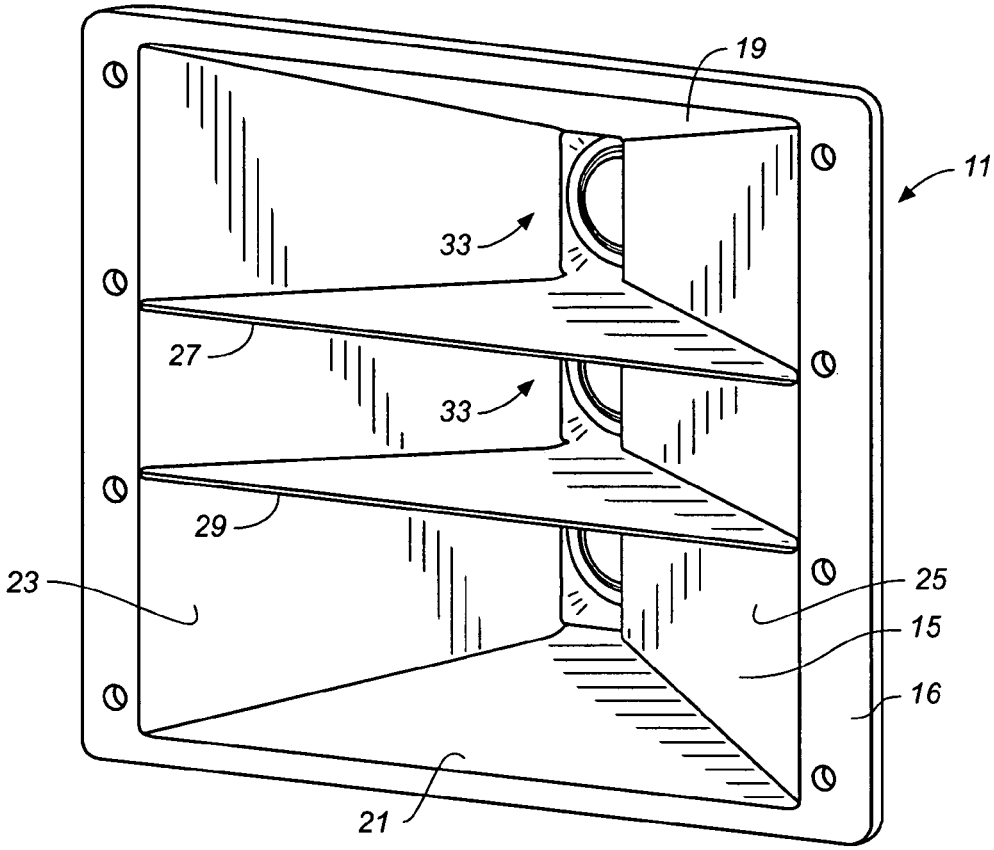
FIG. 1 is a front perspective view of a loudspeaker horn in accordance with the invention with an array of three aligned drivers mounted to the throat end of the horn.
Figure 2:
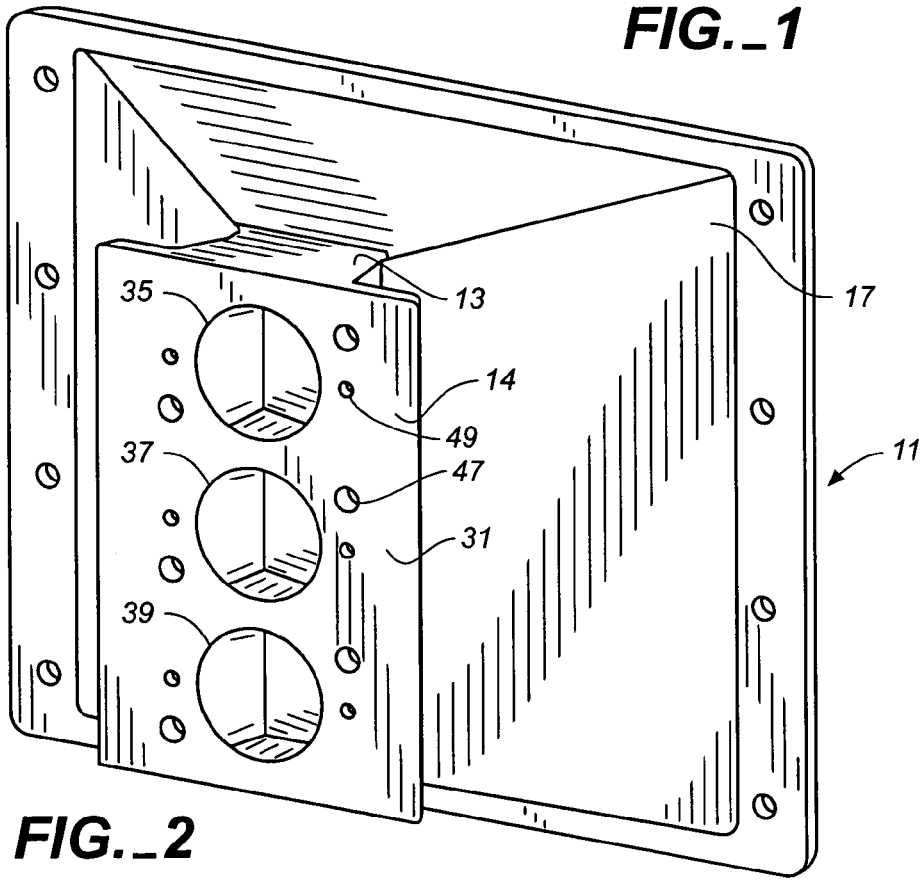
FIG. 2 is a rear perspective view thereof without the drivers.
Figure 4:
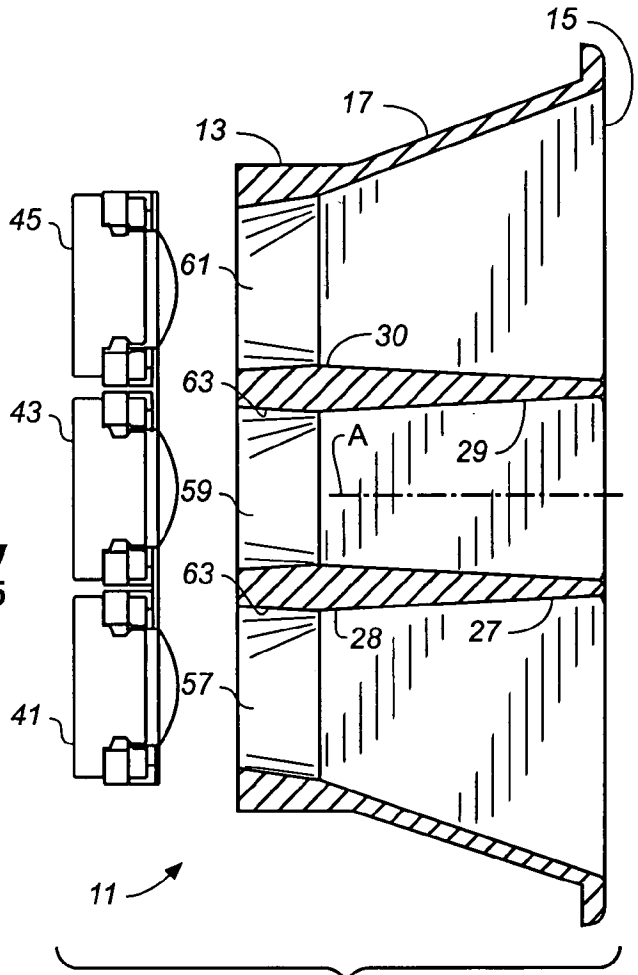
FIG. 4 is a cross-sectional view thereof taken along lines 4-4 in FIG. 3, showing the drivers exploded away from the horn.
Figure 3:
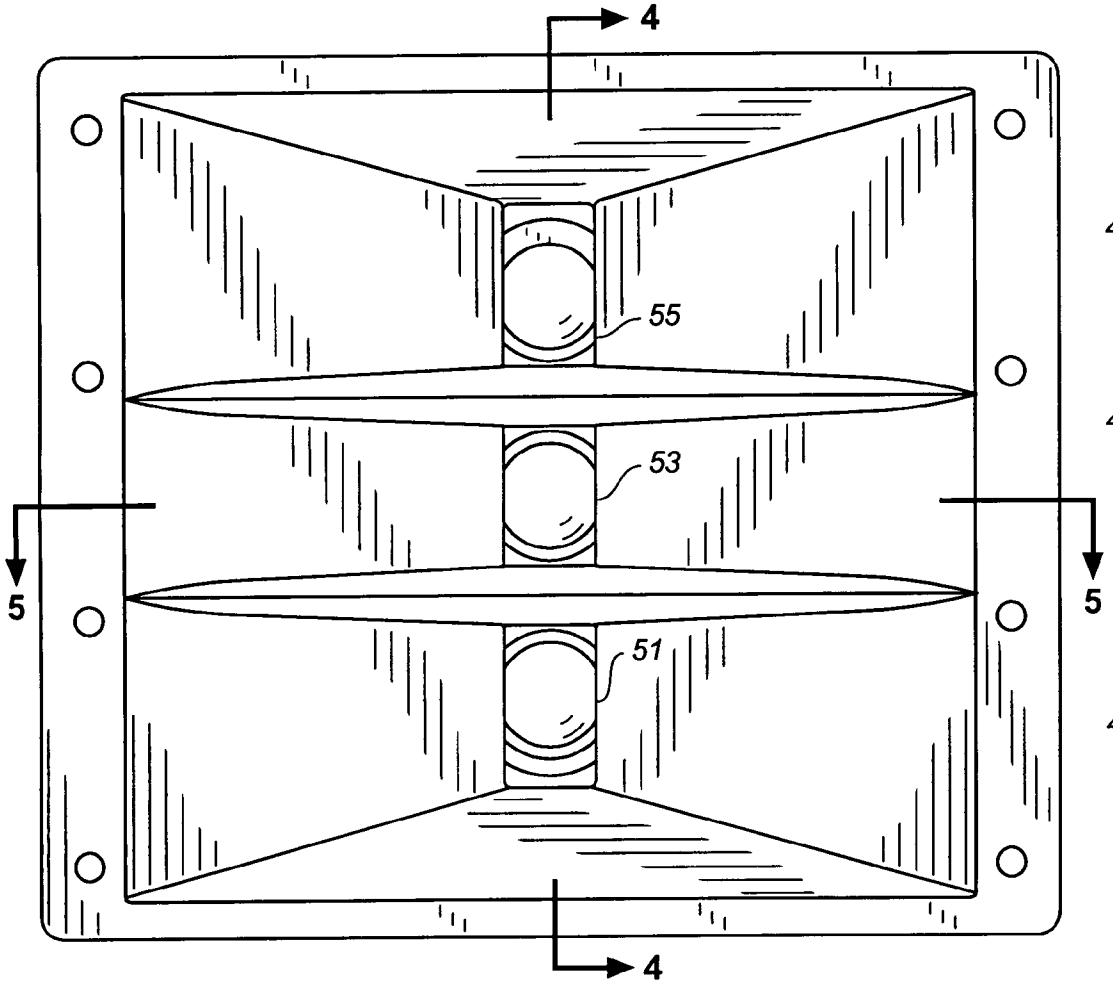
FIG. 3 is a front elevational view thereof.
Figure 5:
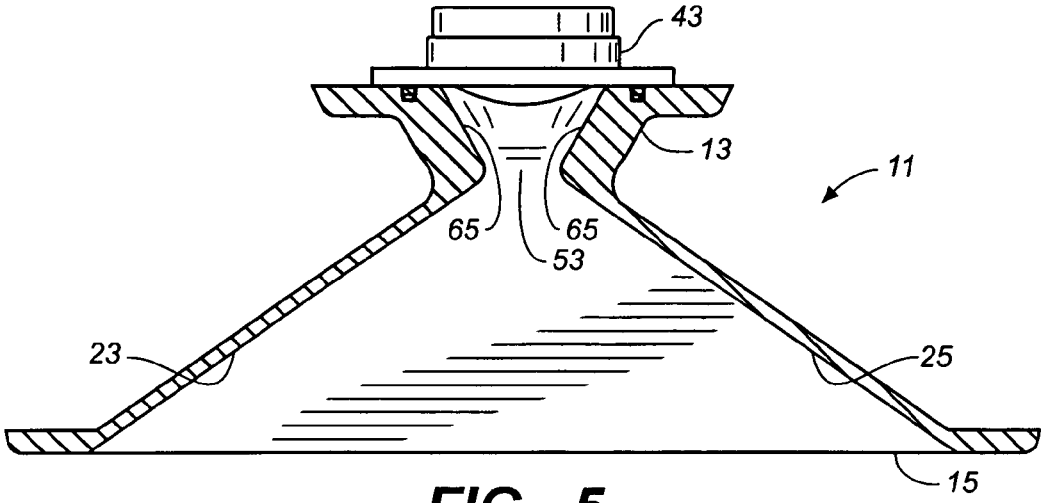
FIG. 5 is a cross-sectional view thereof taken along lines 5-5 in FIG. 3.
Figure 6:
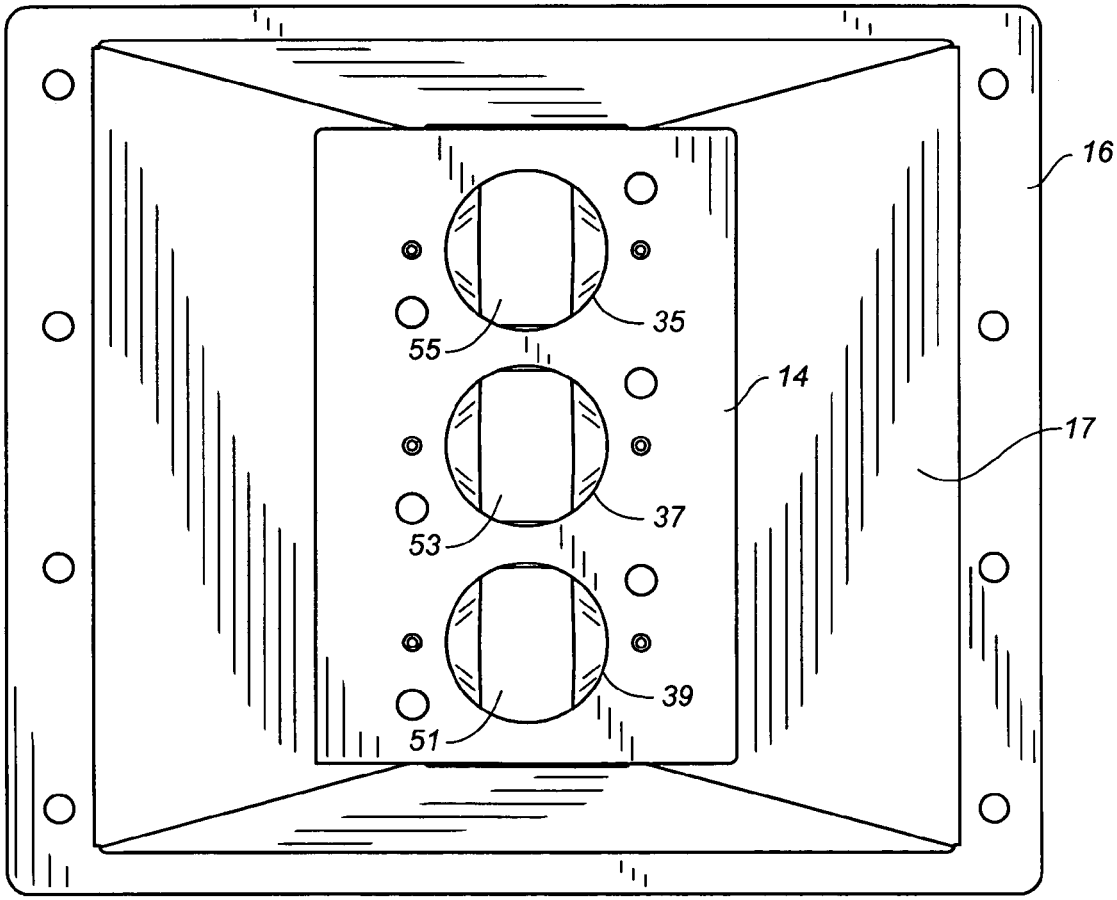
FIG. 6 is a rear elevational view thereof without the drivers.
Figure 7:
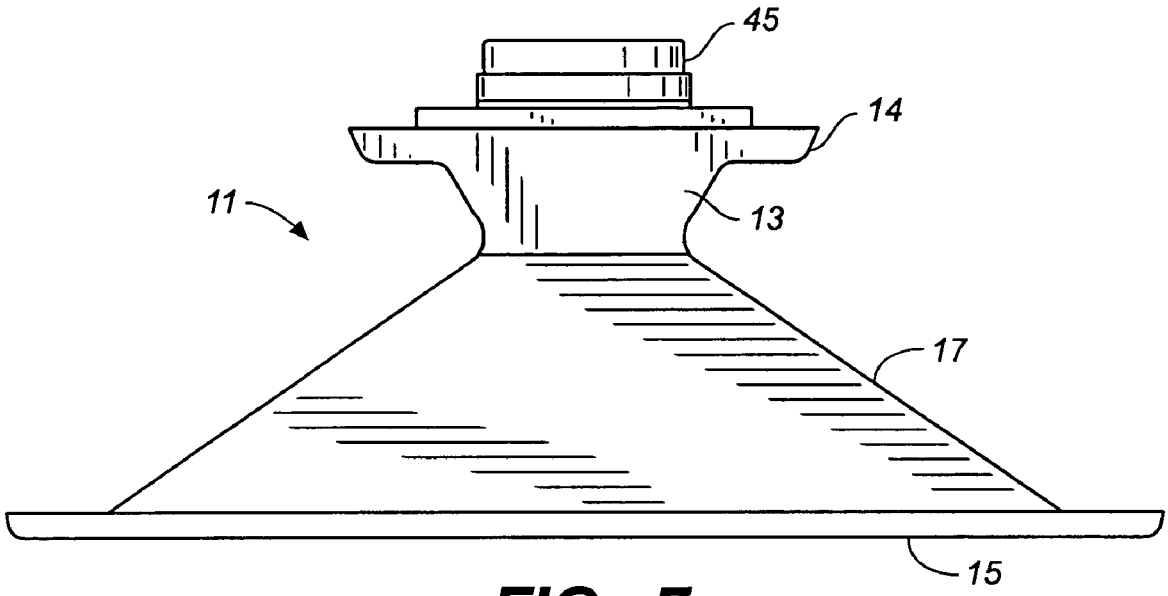
FIG. 7 is side top plan thereof.

The loudspeaker horn shown in the drawings is designed for use with three vertically aligned drivers. The illustrated horn structure provides the desired control for mitigating grating lobes in the vertical direction while acting as a conventional horn in the horizontal direction. It should be noted that the invention is not limited to mitigating grating lobes in one direction only, and can be applied to any number of drivers.

Referring to FIGS. 1-7, the horn 11 includes a throat end 13 having a driver mounting flange 14, a mouth end 15 having flange 16, a flared section 17 formed by flared end walls 19, 21 and flared side walls 23, 25, and grating lobe fins 27, 29. Acoustic power is introduced at the throat end of the horn and is propagated into free space through the horn's mouth end in a characteristic distribution pattern about the horn's main propagation axis A. The grating lobe fins extend in the horizontal direction between side walls 23, 25 of the flared section of the horn and run substantially parallel to the horn's propagation axis between the flared section's end walls 19, 21.

The throat end of the horn extends from mounting surface 31 of driver mounting flange 14 to a throat opening 33 that opens into the flared section of the horn. The throat end provides a means for coupling drivers having a circular geometry that are mounted to the mounting flange to the throat opening which has a rectangular geometry. Specifically, the rectangular driver mounting flange has three aligned circular driver coupling ports 35, 37, 39 for receiving three aligned acoustic power sources in the form of drivers 41, 43, 45, which are mounted to the flange utilizing fastener and alignment pin openings 47, 49 in the mounting surface of the flange. It is contemplated that the drivers will be direct radiator type drivers, for example, a dome tweeter as illustrated in the drawings, mounted more than one wavelength apart at the loudspeakers highest operating frequency range. The drivers, which are mounted in alignment on the mounting flange, preferably matched drivers having substantially the same directionality characteristics so as to form a line array of drivers facing the same direction whose predictable grating lobe behavior under the product theorem mentioned above can be controlled in accordance with the invention.

The predicted grating lobes from the aligned drivers mounted to the horn's mounting flange 14 are controlled by grating lobe fins 27, 29. Each grating lobe fin is seen to have a base end 28, 30 that extends to the horn's throat opening 33 to effectively divide an otherwise elongated throat opening 33 into three aligned rectangular throat openings 51, 53, 55. Each throat opening 51, 53, 55 looks back into a circular to rectangular coupling chamber 57, 59, 61 formed by walls that form the throat end of the horn, such as walls 63 shown in FIG. 4 and walls 65 shown in FIG. 5. The size of the coupling chambers 57, 59, 61 should be on the order of a wavelength or smaller at the highest operating frequency of the loudspeaker.

The grating lobe fins 27, 29 should extend from the horn's throat opening 33 a suitable distance into the horn's flared section 17 to control the predicted grating lobes. For maximum control it is contemplated that the fins will extend all the way to the mouth end of the horn as illustrated in the drawings, however, it may be possible to use somewhat shorter fins and still obtain adequate control. The minimum fin length would have to determined empirically for any given horn design. In general, fins of suitable length will intercept and reflect the acoustic power that would otherwise contribute to the grating lobes back toward the horn's main propagation axis A. In addition to mitigating the predicted grating lobes, this has the advantageous effect of increasing the available on-axis power.

The horn illustrated FIGS. 1-7 can suitably be fabricated as a molded plastic part. The angles and dimensions associated with the flared section 17, throat openings 51, 53, 55, and driver coupling chamber are arrived at empirically to achieve a desired frequency response and sound distribution pattern. It shall be understood that a horn having three aligned drivers is shown for illustrative purposes only and that a horn in accordance with the invention could made to accommodate any number of aligned drivers. The addition of a driver to the line array would require that a driver coupling port and chamber, and a grating lobe fin be added to the horn.

The following is an exemplary application of the loudspeaker horn of the invention used to horn load a line array of drivers that provide the high frequency of full range speaker system having high and low frequency drivers in a speaker box with crossover circuit:

High frequency drivers—horn loaded line array of one inch metal dome drivers (tweeters)

Physical dimensions of horn—driver coupling port diameter=1 inch+

—driver spacing=1.30 inches

—length of driver coupling chamber=0.50 inches

—overall length of horn from driver mounting surface=2.42 inches

—throat openings (51, 53, 55)=0.826×0.50

—mouth of horn (without flange)=5.33 inches

—angle between flared section end walls (19, 21) and grating lobe fins=24.3 degrees Low frequency drivers—two 5 inch cone drivers Speaker box dimensions—23.20 inches wide×7.20 high×8.50 inches deep The above loudspeaker design parameter can achieve an operating frequency range of 60 Hz to 18 kHz without the high frequency driver line array component of the loudspeaker introducing significant grating lobes to the polar response characteristics of the loudspeaker at high frequencies.

FIGS. 8 through 11 show acoustic power distribution patterns in an X-Y plane for various arrangements of acoustic power sources and illustrate the creation of grating lobes as a function of the spacing between sources and the control of grating lobes by controlling the directionality of individual sources within an array.

Figure 8:
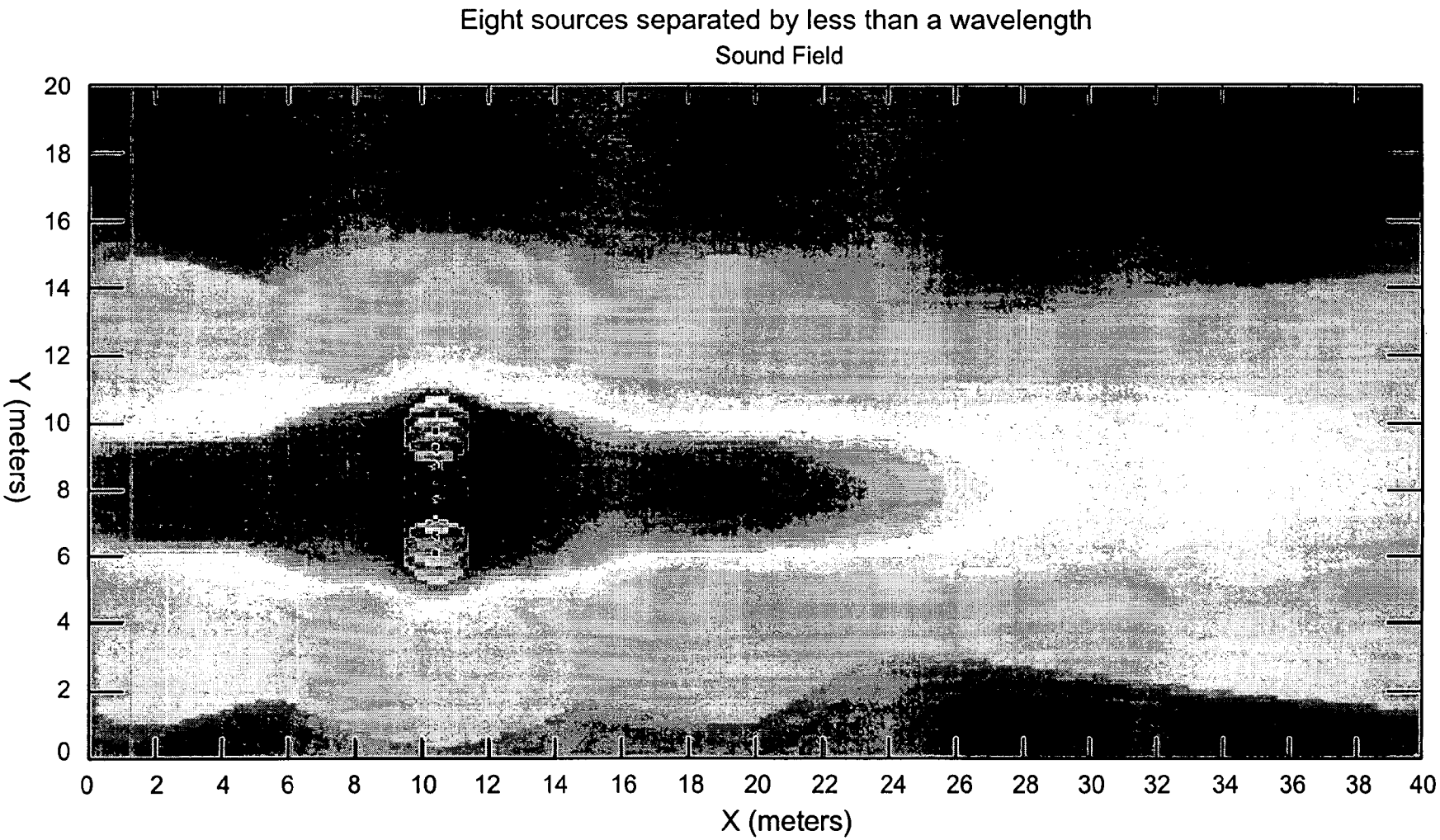
FIG. 8 is a representation of a sound field produced by an array of eight vertically aligned omni directional sources separated by less than a wavelength.

FIG. 8 is a sound field representation for an array of eight vertically aligned omni directional sources separated by less than a wavelength. In this arrangement it can seen that the array is highly directional with no grating lobes. Such arrays would require small acoustic power sources spaced close together (less than a wavelength).

Figure 9:
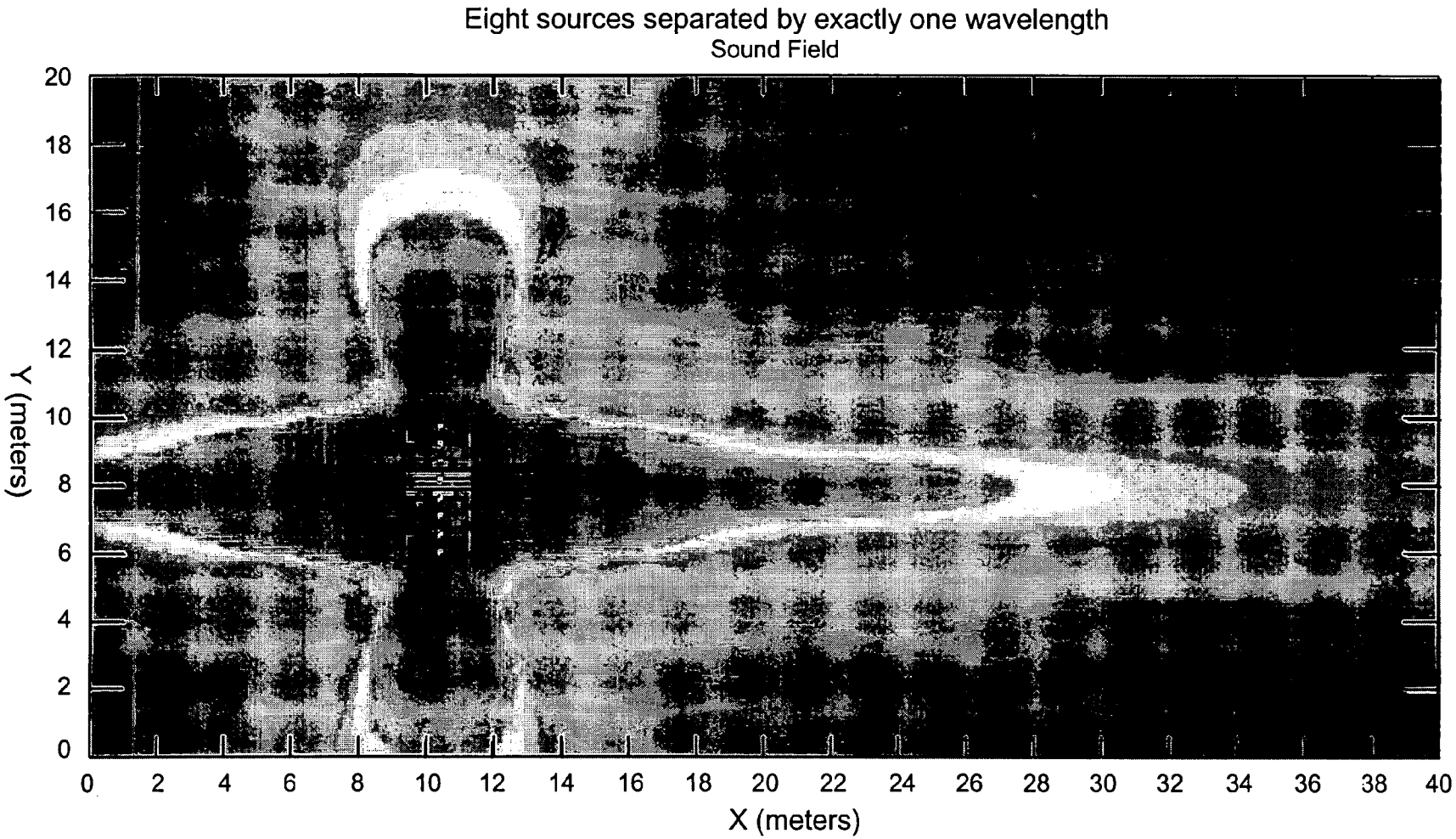
FIG. 9 is a representation of a sound field produced by an array of eight sources separated by exactly a wavelength.

FIG. 9 shows the directionality of an array of eight sources separated by exactly a wavelength. Here the array is seen to produce vertical lobes (in the direction of the y-axis), which are the grating lobes. These grating lobes are equal in magnitude to the main lobe (in the direction of the x-axis), and cannot be mitigated by gain or phase shading.

Figure 10:
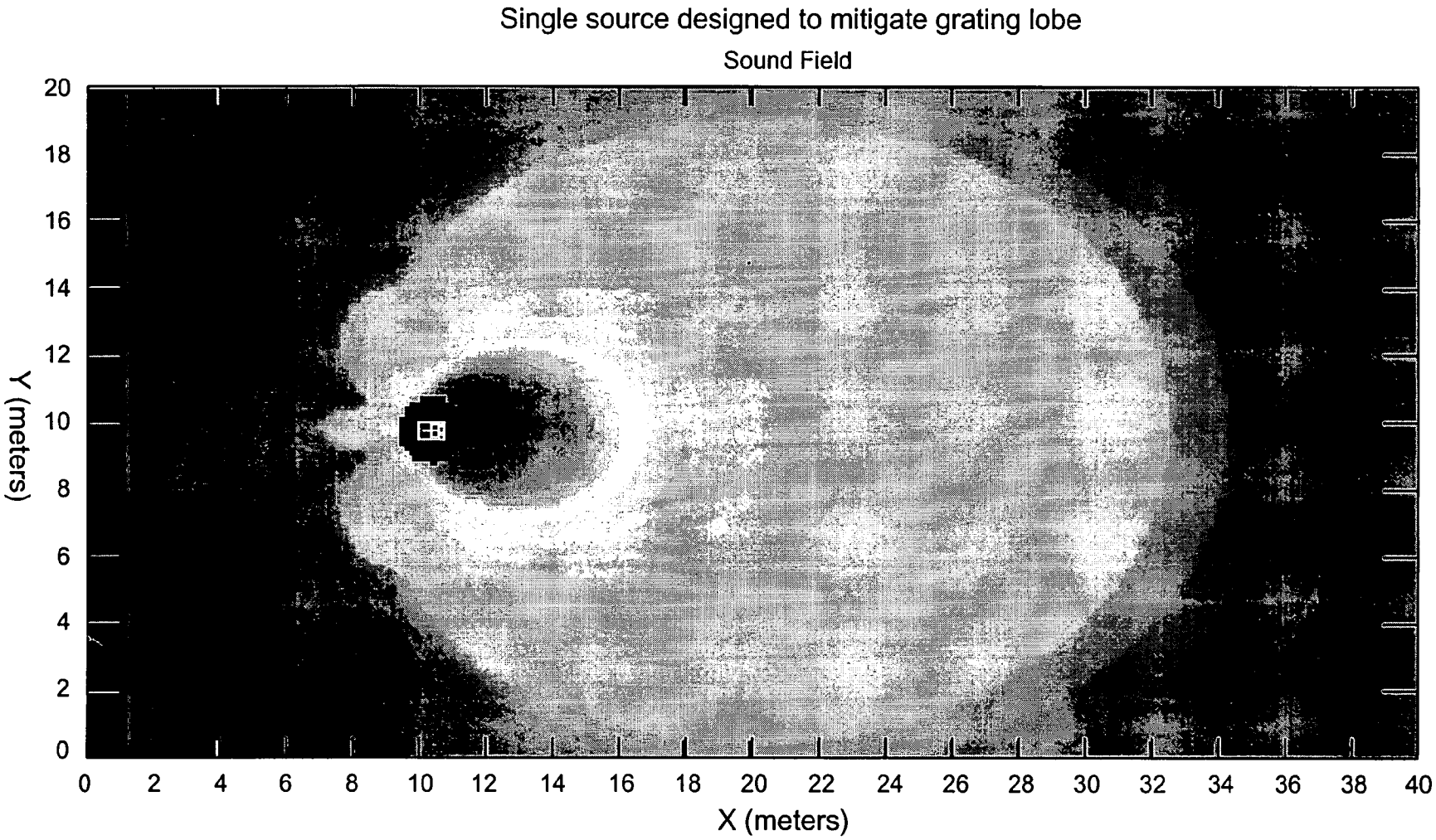
FIG. 10 is a representation of a sound field produced by a single acoustic power source whose directionality has been designed to be as small as practical in the vertical direction where a grating lobe of a vertical line array would be expected.

FIG. 10 shows the directionality of a single acoustic power source (a single speaker) whose directionality has been designed to be as small as practical in the vertical direction where a grating lobe of a vertical line array would be expected. Using a single ascoustic source the length of the grating lobe fins for the horn of the invention, such as horn 11 illustrated and described above, can be determined based of the degree of suppression desired for the grating lobes.

Figure 11:
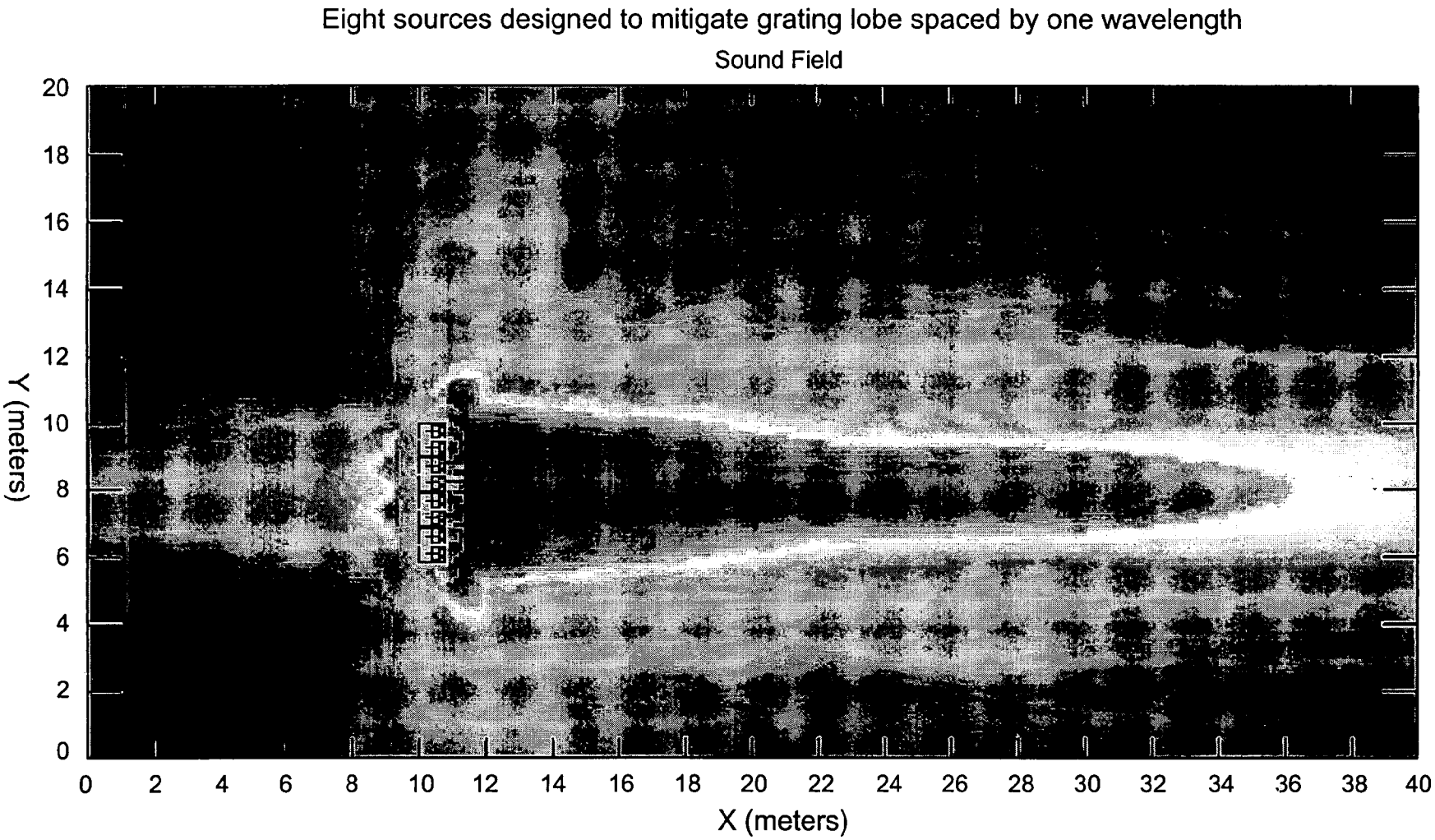
FIG. 11 is a representation of a sound field produced by a vertical array of eight acoustic power sources, each of which is designed with the directionality characteristics of the single source shown in FIG. 10.

FIG. 11 shows a vertical array of eight sources (speakers), each of which is designed with the directionality characteristics of the single source shown in FIG. 10. The directionality characteristics are achieved using the horn of the invention above described wherein acoustic power in any grating lobes produced by the array would be redirected into the sources main lobe. In the array in FIG. 5 the sources are spaced apart one wavelength where significant grating lobes would normally be expected. However, it can see that grating lobes in the FIG. 5 array have been significantly reduced.

While the present invention is described in considerable detail in the foregoing specification, it is not intended that the invention be limited to such detail, except as necessitated by the following claims.

What we claim is:

1. A loudspeaker horn for use with aligned and relatively widely spaced acoustic power sources and having a propagation axis, said loudspeaker horn comprising a relatively short throat end having a transversely elongated throat for receiving acoustic power from aligned acoustic power sources mounted to said throat end, said elongated throat having a top, a bottom, and elongated sides defining a long dimension, a flared section extending from said throat end, said flared section having end walls extending from the top and bottom of said throat and flared side walls extending from the elongated sides of said throat, said flared section further having a mouth end through which acoustic power received at the throat end of the loudspeaker horn is propagated into space in a characteristic distribution pattern, and grating lobe mitigation fins disposed in said flared section between the end walls thereof, said grating lobe mitigation fins being disposed in planes substantially perpendicular to the long dimension of said throat and substantially parallel to the horn's propagation axis, and extending for a substantial distance from the throat of the horn toward the mouth end of said flared section for mitigating grating lobes produced by aligned acoustic power sources at the throat end of the horn.

2. The loudspeaker horn of claim 1 wherein said grating lobe mitigation fins extend from the throat end of the horn to near the mouth end of the flared section of the horn.

3. The loudspeaker horn of claim 1 wherein said grating lobe mitigation fins extend from the throat end of the horn substantially the entire length of the flared section of the horn.

4. The loudspeaker horn of claim 1 wherein the throat end of the horn further includes coupling chambers associated with the aligned acoustic power sources for coupling acoustic power produced by the acoustic power sources to the horn's elongated throat.

5. The loudspeaker horn of claim 4 wherein said coupling chambers transition from a round geometry at the acoustic power sources to a rectangular geometry at the horn's elongated throat.

6. The loudspeaker horn of claim 5 wherein the size of each of said coupling chambers is in the order of one wavelength or smaller at the highest operating frequency of the loudspeaker.

7. The loudspeaker horn of claim 4 wherein said grating lobe mitigation fins each have a base end which extends into the throat end of the horn to isolate the coupling chambers one from the other and to divide the elongated throat into aligned throat openings associated with each acoustic power source of said aligned acoustic power sources.

8. The loudspeaker horn of claim 1 wherein said throat end of the horn is formed to received acoustic power from N aligned acoustic power sources where N is an integer, and wherein N−1 grating lobe mitigation fins are provided between the end walls of said flared section.

9. The loudspeaker horn of claim 1 wherein said throat end of the horn is formed to receive acoustic power from three aligned acoustic power sources, and wherein two grating-lobe mitigation fins are provided between the end walls of said flared section.

10. The loudspeaker horn of claim 1 wherein the throat end of said horn includes a mounting surface for mounting multiple acoustic power sources to the throat end of the horn in aligned relation with the horn's elongated throat.

11. A horn for a loudspeaker for use with aligned and relatively widely spaced acoustic power sources and having a propagation axis, said loudspeaker horn comprising a relatively short throat end having a transversely elongated rectangular throat and aligned coupling chambers for coupling acoustic power produced by aligned acoustic power sources having a circular geometry and which are mounted to said throat end to the rectangular geometry of the horn's elongated throat, said elongated throat having a top, a bottom, and elongated sides defining a long dimension, a flared section extending from said throat end, said flared section having end walls extending from the top and bottom of said elongated throat, and flared side walls extending from the elongated sides of said throat, a mouth end at the end of the flared section opposite said throat end through which acoustic power received at said throat end is propagated from the loudspeaker horn into space, and grating lobe mitigation fins disposed in said flared section between the end walls thereof, said grating lobe mitigation fins being disposed in planes substantially perpendicular to the long dimension of said throat and substantially parallel to the horn's propagation axis, and extending for a substantial distance from the throat of the horn toward the mouth end of said flared section for mitigating grating lobes produced by aligned acoustic power sources at the throat end of the horn.

12. The loudspeaker horn of claim 11 wherein the throat end of said horn includes a mounting surface having aligned, circular openings therein associated with said coupling chambers for mounting multiple circular acoustic power sources to the throat end of the horn in aligned relation with the horn's elongated rectangular throat.

13. The loudspeaker horn of claim 12 wherein said mounting surface is provided by an elongated rectangular flange.

14. The loudspeaker horn of claim 11 wherein said grating lobe mitigation fins extend from the throat end of the horn to near the mouth end of the horn.

15. The loudspeaker horn of claim 11 wherein said grating lobe mitigation fins extend from the throat end of the horn substantially the entire length of the flared section of the horn.

16. The loudspeaker horn of claim 11 wherein said grating lobe mitigation fins are tapered in the direction of the mouth end of the horn.

17. A horn for a loudspeaker for use with aligned and relatively widely spaced acoustic power sources, said loudspeaker horn comprising a relatively short throat end for receiving acoustic power from aligned acoustic power sources mounted thereto, a flared section having flared side walls that converge to a transversely elongated throat at the throat end of the horn, said elongated throat being divided into aligned throat openings associated with the acoustic power sources of aligned acoustic power sources, and grating lobe mitigation fins in said flared section extending from between the aligned throat openings of said throat end a substantial distance toward the mouth end of the flared section of the horn a sufficient distance for mitigating grating lobes produced by aligned acoustic power sources at the throat end of the horn.

18. The loudspeaker horn of claim 17 wherein the loudspeaker horn has a propagation axis and said grating lobe mitigation fins extending from between the aligned throat openings of said throat substantially parallel to said propagation axis.

19. The loudspeaker horn of claim 17 wherein the throat end of the loudspeaker horn includes coupling chambers aligned behind said elongated throat for coupling the each acoustic power source of said aligned acoustic power sources with each throat opening of said aligned throat openings.

20. The loudspeaker horn of claim 19 wherein said coupling chambers transition from a round geometry at the acoustic power sources to a rectangular geometry at the throat openings of the horn's transversely elongated throat.

21. The loudspeaker horn of claim 19 wherein the size of each of said coupling chambers is in the order of one wavelength or smaller at the highest operating frequency of the loudspeaker.

22. The loudspeaker horn of claim 19 wherein said grating lobe mitigation fins extend from the throat end of the horn to near the mouth end of the flared section of the horn.

23. The loudspeaker horn of claim 19 wherein said grating lobe mitigation fins extend from the throat end of the horn substantially the entire length of the flared section of the horn.

24. A horn loudspeaker comprising a. a horn comprised of i.) a relatively short throat end with a transversely elongated throat having a top, a bottom, and elongated sides defining a long dimension, and ii.) a flared section extending from said throat end, said flared section having end walls extending from the top and bottom of said throat, and flared side walls extending from the elongated sides of said throat, said flared section further having a mouth end through which acoustic power received at the throat end of said horn is propagated into space in a characteristic distribution pattern, b. aligned acoustic power sources mounted to the throat end of said horn and spaced apart by at least one wavelength at the highest operating frequency of the loudspeaker, and c. grating lobe mitigation fins disposed in the flared section of said horn between the end walls thereof, said grating lobe mitigation fins being disposed in planes substantially perpendicular to the long dimension of the throat of said horn and substantially parallel to the horn's propagation axis, and extending for a substantial distance from the throat of the horn toward the mouth end of said flared section for mitigating grating lobes produced by aligned acoustic power sources at the throat end of the horn.

25. The loudspeaker horn of claim 24 wherein said grating lobe mitigation fins extend from the throat end of the horn to near the mouth end of the flared section of the horn.

26. The loudspeaker horn of claim 24 wherein said grating lobe mitigation fins extend from the throat end of the horn substantially the entire length of the flared section of the horn.

27. A method of suppressing grating lobes produced by aligned and relatively widely spaced acoustic power sources comprising selecting acoustic power sources for an aligned array of acoustic power sources, selecting a horn having a relatively short throat end to which said aligned array of acoustic power sources can be mounted, wherein the throat end of said horn has a transversely elongated throat for receiving acoustic power from said aligned array of acoustic power sources, and wherein the horn has a flared section which extends from the throat end of said horn and which terminates at a mouth end through which acoustic power received from the aligned array of acoustic power sources at the throat end of the horn is propagated into space in a characteristic distribution pattern, providing grating lobe mitigation fins in the flared section of said horn which are substantially parallel to the propagation axis of the horn, the length of said grating lobe mitigation fins being selected to achieve a desired level of suppression of the grating lobes produced by said aligned array of acoustic power sources.

28. The method of claim 27 wherein the length of said grating lobe mitigation fins is determined empirically.

29. The method of claim 27 wherein said aligned acoustic power sources are matched drivers, and wherein the length of said grating lobe fins is determined empirically using a single driver.

30. The method of claim 27 wherein the length of said grating lobe fins is determined empirically by choosing a desired acoustic power sources for the aligned array of acoustic power sources, determining the length of the grating lobe fins needed to achieve directional characteristics for a single one of the aligned acoustic power sources that suppresses off-axis acoustic power for the acoustic power source in the region of the predicted grating lobes for the aligned power sources to the desired suppression levels for the grating lobes, and providing the flared section of the horn with grating lobe fins of the determined length using the single acoustic power source, or longer.

31. The method of claim 30 wherein said aligned acoustic power sources are matched drivers.

* * * * *